US011463811B2

(12) United States Patent
Riggs et al.

(10) Patent No.: US 11,463,811 B2
(45) Date of Patent: Oct. 4, 2022

(54) SPEAKER SYSTEM WITH OVERHEAD SOUND PROJECTION

(71) Applicant: Harman International Industries, Incorporated, Stamford, CT (US)

(72) Inventors: Jason Riggs, Stamford, CT (US); Hussnain Ali, Frisco, TX (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 17/224,773

(22) Filed: Apr. 7, 2021

(65) Prior Publication Data

US 2021/0321196 A1 Oct. 14, 2021

Related U.S. Application Data

(60) Provisional application No. 63/008,279, filed on Apr. 10, 2020.

(51) Int. Cl.
*H04R 5/02* (2006.01)
*H04R 3/04* (2006.01)

(52) U.S. Cl.
CPC ..... *H04R 5/02* (2013.01); *H04R 3/04* (2013.01); *H04R 2205/024* (2013.01)

(58) Field of Classification Search
CPC ..... H04R 5/02; H04R 3/04; H04R 2205/24
See application file for complete search history.

(56) References Cited

U.S. PATENT DOCUMENTS

| | | | | |
|---|---|---|---|---|
| 3,627,948 | A * | 12/1971 | Nichols | H04R 5/02 181/154 |
| 4,450,929 | A * | 5/1984 | Marrs | H04R 1/2811 181/146 |
| 2017/0048612 | A1* | 2/2017 | Devergie | H04R 1/345 |
| 2018/0242077 | A1* | 8/2018 | Smithers | H04R 1/30 |
| 2020/0014993 | A1* | 1/2020 | Alexander | H04R 1/26 |
| 2020/0084538 | A1* | 3/2020 | Brown | H04R 1/345 |
| 2021/0014633 | A1* | 1/2021 | Freeman | H04S 7/301 |

FOREIGN PATENT DOCUMENTS

WO 2018112335 A1 6/2018

* cited by examiner

*Primary Examiner* — Andrew L Sniezek
(74) *Attorney, Agent, or Firm* — Brooks Kushman P.C.

(57) ABSTRACT

A speaker system is provided with a cabinet with a front face. At least one forward-firing driver is supported by the cabinet to project sound along a first axis that is generally perpendicular to the front face of the cabinet. At least one upward-firing driver is supported by the cabinet and arranged above the at least one forward-firing driver to project high frequency sound along a second axis that is angularly offset from the first axis at an acute splay angle. A controller is programmed to provide a mid-range frequency component of a front audio channel to the at least one forward-firing driver, and to provide a high frequency component of a top audio channel to the upward-firing driver.

20 Claims, 6 Drawing Sheets

SPEAKER SYSTEM WITH OVERHEAD SOUND PROJECTION

CROSS-REFERENCE TO RELATED APPLICATIONS

This application claims the benefit of U.S. provisional application Ser. No. 63/008,279 filed Apr. 10, 2020, the disclosure of which is hereby incorporated in its entirety by reference herein.

TECHNICAL FIELD

One or more embodiments relate to a speaker system with overhead sound projection.

BACKGROUND

Audio systems may include a plurality of speakers to provide sound from a 360° radius in a horizontal plane (i.e., "surround" sound). Audio systems may also include speakers to provide sound within a vertical plane, including floor mounted speakers in combination with speakers mounted to the ceiling.

SUMMARY

A speaker system is provided with a cabinet with a front face and at least one forward-firing driver supported by the cabinet to project sound along a first axis that is generally perpendicular to the front face of the cabinet. At least one upward-firing driver is supported by the cabinet and arranged above the at least one forward-firing driver at an acute splay angle, wherein the at least one upward-firing second driver is adapted to project sound at a frequency above 1 kHz upward along a second axis that is angularly offset from the first axis at the acute splay angle.

In one or more embodiments, a speaker system is provided with a cabinet with a front face. At least one forward-firing driver is supported by the cabinet to project sound along a first axis that is generally perpendicular to the front face of the cabinet. At least one upward-firing driver is supported by the cabinet and arranged above the at least one forward-firing driver to project high frequency sound along a second axis that is angularly offset from the first axis at an acute splay angle. A controller is programmed to provide a mid-range frequency component of a front audio channel to the at least one forward-firing driver, and to provide a high frequency component of a top audio channel to the upward-firing driver.

In one or more embodiments, a speaker system is provided with a cabinet with a front face and three drivers: a first driver, a second driver, and a third driver, that are supported by the cabinet. The first driver projects sound along a first axis that is generally perpendicular to the front face of the cabinet. The second driver is arranged above the first driver to project high frequency sound along a second axis that is angularly offset from the first axis at an acute splay angle. The third driver is arranged below the first driver to project low frequency sound along a third axis that is generally parallel to the first axis. A controller is programmed to: provide a mid-range frequency component of a front audio channel to the first driver, provide a high frequency component of a top audio channel to the second driver to project as mid-range frequency sound along the second axis, and provide a low frequency component of the front audio channel to the third driver.

In one or more embodiments, a method for projecting overhead sound from a speaker system is provided. A mid-range frequency component of a front audio channel is provided to a first driver to project sound along a first axis that is generally perpendicular to a front face of a cabinet. A high frequency component of a top audio channel is provided to a second driver to project as high frequency sound along a second axis that is angularly offset from the first axis at an acute splay angle. A low frequency component of the front audio channel is provided to a third driver to project low frequency sound along a third axis that is generally parallel to the first axis.

DETAILED DESCRIPTION

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
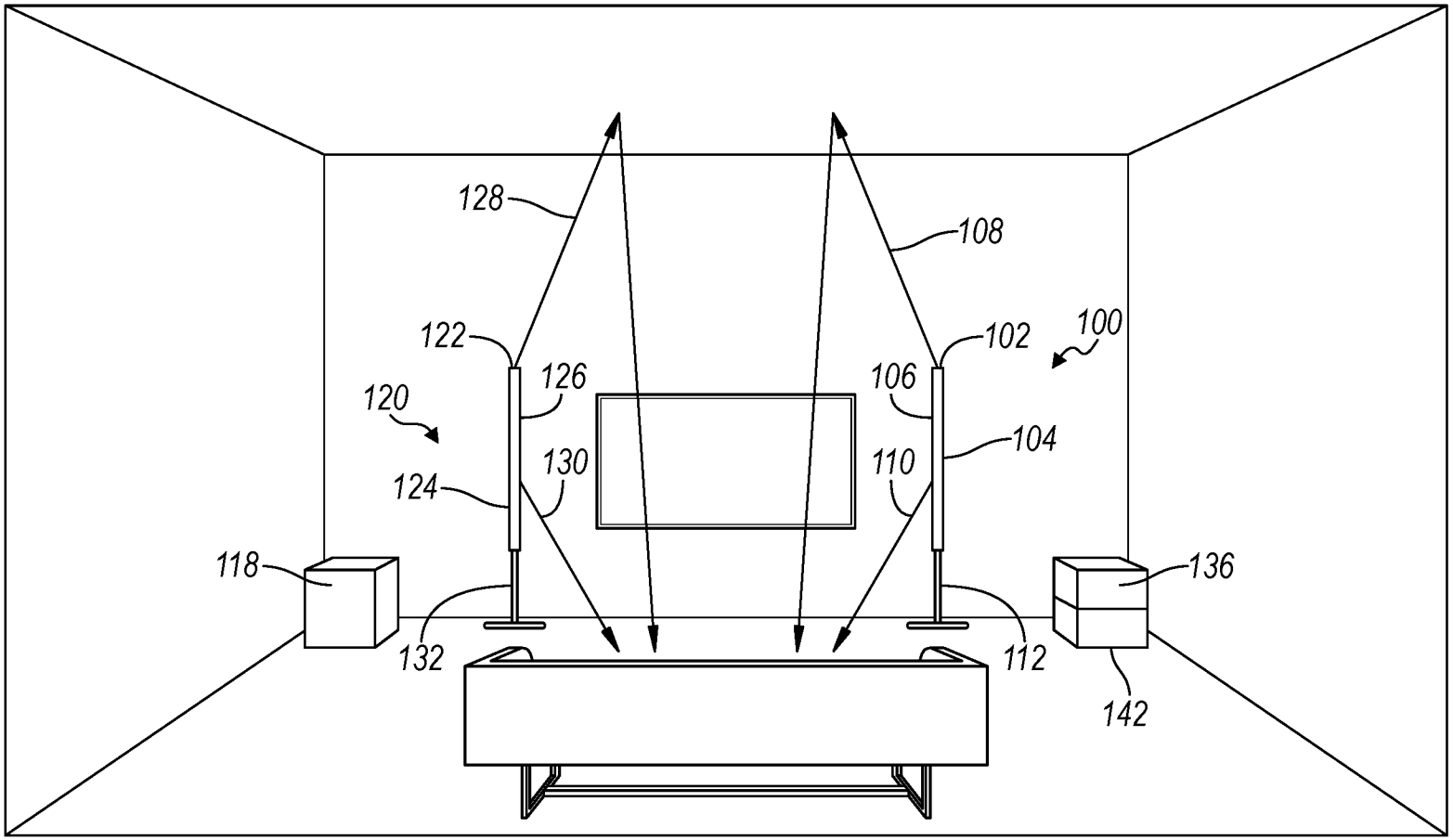
FIG. 1 is a front perspective view of an audio system including speaker systems with overhead sound projection within a listening environment according to one or more embodiments.

With reference to FIG. 1, a speaker system with overhead sound projection is illustrated in accordance with one or more embodiments and represented by numeral 100. The speaker system 100 includes an upward-firing driver 102 and one or more forward-firing driver(s) 104 that are supported by a cabinet 106. The upward-firing driver 102 is mounted to an upper portion of the cabinet 106 and arranged to project a top-firing sound beam about an upward axis 108 toward an upper surface, e.g., a ceiling, which reflects toward a target listening area. This reflected top-firing sound beam simulates sound generated by a speaker mounted to the ceiling (not shown). The forward-firing driver 104 is mounted below the upward-firing driver 102 within the cabinet and arranged to project a forward sound beam about a forward axis 110 and out of a front face of the cabinet 106 toward the target listening area. The speaker system 100 includes a base 112 that rests upon an underlying surface and supports the cabinet 106 in a tower or column configuration, according to one or more embodiments.

The speaker system 100 may be combined with other audio, visual and peripheral devices to provide a home entertainment system 114. In one or more embodiments, the audio devices include a box speaker 118 and a second speaker system 120 that are distributed at various positions within the room to provide sound from a wide radius in the horizontal plane. In other embodiments, the home entertainment system 114 also includes side speakers and rear speakers (not shown) to collectively provide 360 degree "surround" sound. Like the speaker system 100, the second speaker system 120 includes an upward firing driver 122 and one or more forward firing drivers 124 that are supported by a cabinet 126. The upward firing driver 122 projects a top-firing sound beam about an upward axis 128 and the forward firing driver(s) 124 project a forward sound beam about a forward axis 130 directly toward the target listening area. The second speaker system 120 also includes a base 132 that supports the cabinet 126 in a tower or column configuration. The speakers may be portable wireless speakers or fixed wired speakers.

The home entertainment system 114 may also include a television 134 and an audio source 136 such as a DVD player, a video game console, an audio receiver, and a router. The home entertainment system 114 also includes a home controller 142 for controlling various aspects of the devices included in the home entertainment system 114. For example, the home controller 142 may separate audio from the audio source 136 into multiple channels corresponding to different locations in the room, e.g., front-center, front-left, front-right, rear-left, rear-right, top-left, top-right, etc. The home controller 142 may include crossover functionality and separate the audio into different channels based on frequency, e.g., high, medium, low, etc. The home controller 142 may provide audio channels to the appropriate speaker. For example, the home controller 142 may provide the front-right and top-right audio channels to the speaker system 100, and the front-left and top-left audio channels to the second speaker system 120. In other embodiments, the home controller 142 provides all audio channels to each speaker, and the speaker selects the appropriate channels based on its location.

As described above, the home controller 142 may separate the audio into multiple channels, including top channels, or height channels. Such top channels may be used by audio sources to simulate stationary or moving overhead sound, e.g., a plane flying overhead. Existing home audio systems may include ceiling mounted speakers (not shown) to provide such top channel sound. However, ceiling mounted speakers may be expensive and difficult to install and/or move after installation.

Figure 2:
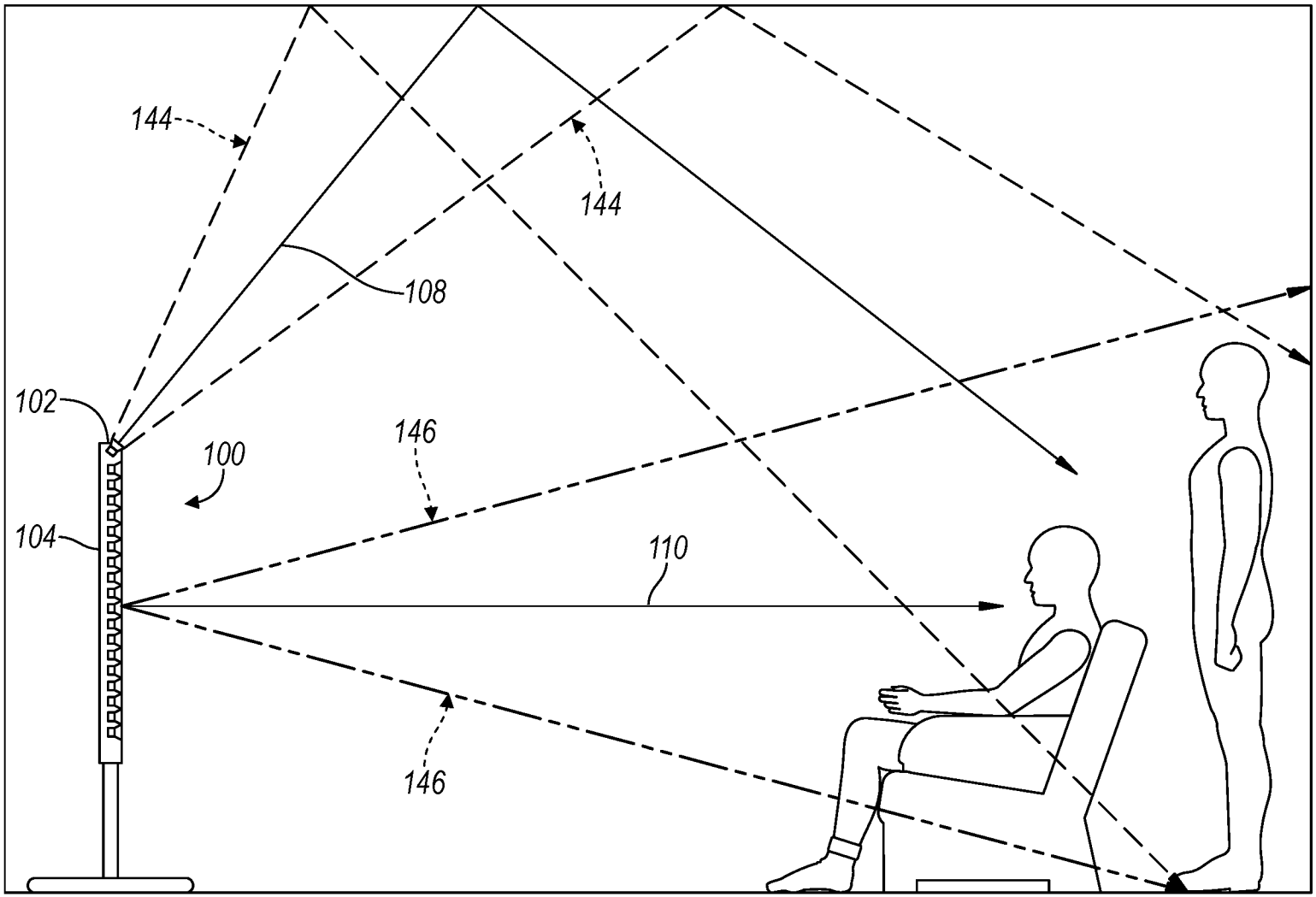
FIG. 2 is a side view of one of the speaker systems of FIG. 1, illustrating overhead sound projection and forward sound projection.

With reference to FIG. 2, the speaker system 100 simulates overhead sound from a floor mounted speaker assembly, which is generally less expensive and easier to install than a ceiling mounted speaker. The upward-firing driver 102 projects a top-firing sound beam 144 (shown in dashed line) toward the ceiling about the upward axis 108, and the beam reflects downward toward the target listening area. The surface of the ceiling is made of an appropriate material and texture to reflect the top-firing sound beam 144 down into the listening environment. The forward-firing driver 104 projects a forward sound beam 146 (shown in dashed lined) about the forward axis 110 into the listening environment. The top-firing sound beam 144 takes longer to reach the target listening area than the forward sound beam 146 due to its indirect sound path and the spatial distance between the sound beams.

Figure 3:
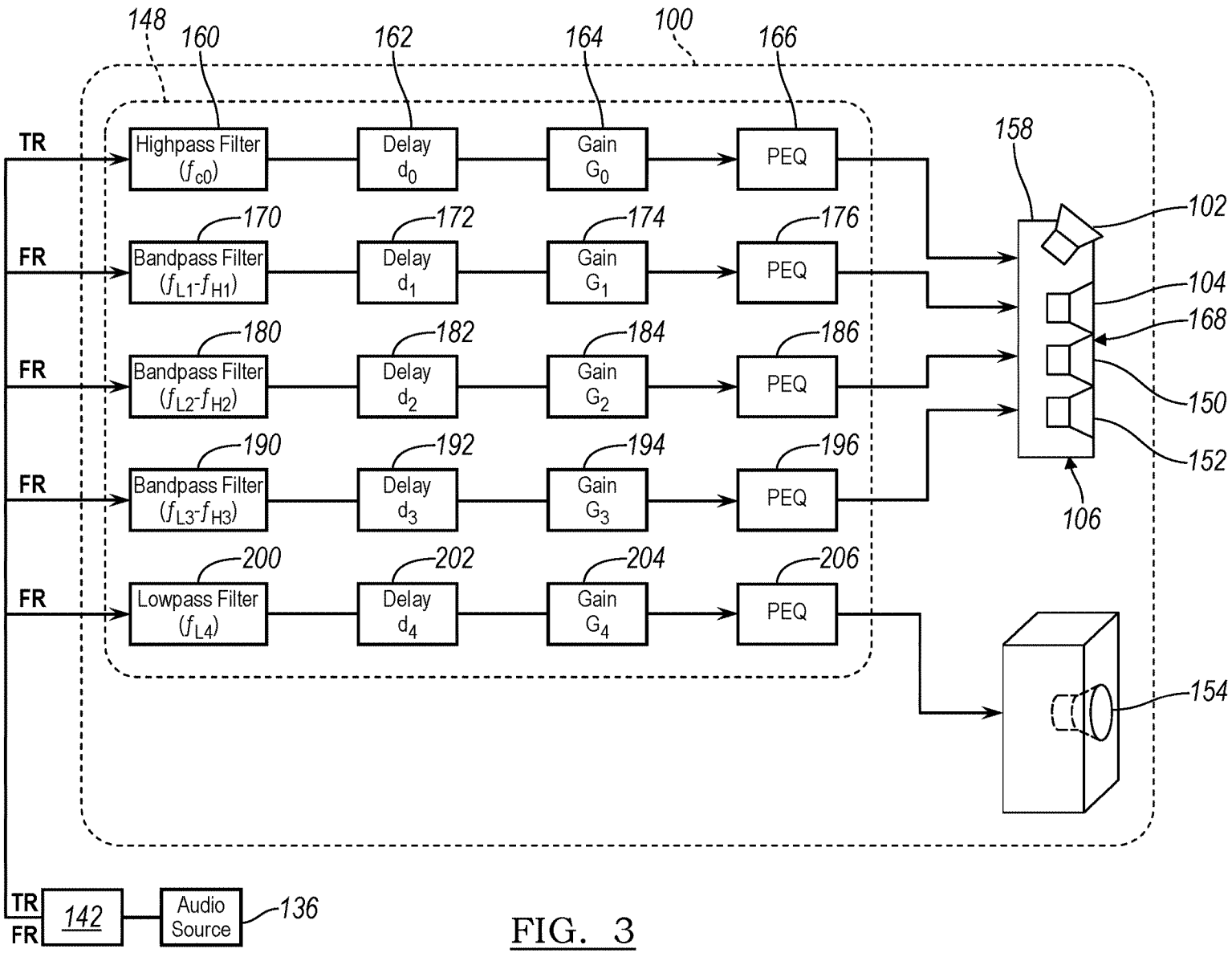
FIG. 3 is a schematic diagram of the speaker system of FIG. 2, according to one or more embodiments.

Referring to FIG. 3, the speaker system 100 is a passive or active speaker system with a line array of drivers arranged in a narrow cabinet according to one or more embodiments. The speaker system 100 includes a controller 148 that is connected to a separate amplifier (not shown). The speaker system 100 includes the upward-firing driver 102 and a plurality of forward firing drivers that are arranged within a vertical line array within a cabinet 106 in a tower/column speaker configuration. The plurality of forward firing drivers include: the first forward-firing driver 104, a first intermediate driver 150, a second intermediate driver 152, and a lower driver 154. The lower driver 154 may be a single full-range driver or a plurality of drivers arranged in any configuration to provide forward facing sound.

Directivity is a measure of the directional characteristic of a sound source. It is often expressed as a Directivity Index in decibels, or as a dimensionless value of Q. Directivity indicates how much sound will be directed towards a specific area/direction compared to all the sound energy being generated by a source. An increased directivity means that sound energy is saturated in a particular direction.

The speaker system 100 includes a vertical line array of constant beam-width transducers (drivers) to provide a generally uniform sound field and superior directivity within the listening area. The drivers are small diameter drivers, e.g., 20-40 mm, to fit within a narrow cabinet, such as the Radiance Tower™ by Harman according to one or more embodiments. Conventional speakers typically provide one sweet spot, whereas with the speaker system 100, the entire targeted listening area is a sweet spot. Superior directivity behavior with SSTs means that custom acoustic beams, can be implemented to direct the sound to specific directions with high directivity. Not only that, multiple acoustic beams can be superimposed to deliver different sounds at different locations/angles. This makes SSTs a favorable solution to direct an acoustic beam directly towards the listener as well as towards the ceiling (to provide a sensation of overhead sound) simultaneously from the same array.

The home controller 142 separates the audio signal into multiple channels corresponding to different locations and provides one or more channels to the controller 148 that are associated with the location of the speaker system 100, e.g., a front-right channel (FR) and a top-right channel (TR).

The controller 148 includes circuitry for conditioning the channel signal for each driver to improve the directivity of the speaker system 100. The controller 148 includes crossover filters for separating the channel signal into different frequency bands. The controller 148 may also include delay circuits to time align the forward-firing drivers 104, 150, 152, and 154 with the upward-firing driver 102 by compensating for a spatial distance between the corresponding sound beams relative to the listening area. The controller 148 may also include gain circuits to amplify sound components, or attenuation circuits to attenuate sound components, to compensate for a difference in efficiency between drivers or perform amplitude shading across the drivers. The controller 148 may also include equalization circuits to adjust the frequency response of each driver to achieve a cumulative (overall) desired frequency response. The controller 148 could be implemented via a digital signal processor (DSP) or could include analog transmission-line circuit components, e.g., inductors, capacitors, and resistors according to one or more embodiments.

Although the controller 148 is shown as a single controller, it may contain multiple controllers, or may be embodied as software code within one or more other controllers. The controller 148 generally includes any number of microprocessors, ASICs, ICs, memory (e.g., FLASH, ROM, RAM, EPROM and/or EEPROM) and software code to co-act with one another to perform a series of operations. Such hardware and/or software may be grouped together in assemblies to perform certain functions. Any one or more of the controllers or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof. The controller 148, also includes predetermined data, or "look up tables" that are stored within memory, according to one or more embodiments.

It should be noted that the upward-firing driver 102 is a high frequency tweeter that is mounted to an upper portion 158 of the cabinet 106, according to one or more embodiments. In one or more embodiments, the upward-firing driver 102 is a high intensity, high sensitivity, small diameter high frequency (1.3 kHz-20 kHz) tweeter. The controller 148 includes circuitry for conditioning the top-right (TR) channel signal that is provided to the upward-firing driver 102. The controller 148 includes a high pass filter 160 with a cutoff frequency ($f_{c0}$) to remove the low frequency portion of the TR channel signal. In one or more embodiments the cutoff frequency ($f_{c0}$) is 1.5 kHz. The controller 148 also includes a delay circuit 162 with a delay ($d_0$) to compensate for a spatial distance between the corresponding sound beams relative to the listening area. Since the top-firing sound beam 144 takes an indirect path to the listening area, it is typically the slowest signal. Therefore, in one or more embodiments the delay ($d_0$) is zero seconds. The controller 148 includes a gain circuit 164 with a gain ($G_0$) to amplify sound components to compensate for a difference in efficiency between drivers. Since the upward-firing driver 102 is a high efficiency, high frequency tweeter, ($G_0$) is equal to one, or unity gain, according to one or more embodiments. The controller 148 also includes an equalization circuit 166 with a parametric equalizer (PEQ) filter to implement height-cue filters and change the frequency response of the acoustic beam.

The first forward-firing driver 104 is a wide-band driver that is mounted below the upward-firing driver 102 within the cabinet 106 and arranged to project the forward sound beam 146 about the forward axis 110 and out of a front face 168 of the cabinet 106 toward the target listening area, according to one or more embodiments. In one or more embodiments, the first forward-firing driver 104 is a mid-range driver. The controller 148 includes circuitry for conditioning the front-right (FR) channel signal that is provided to the first forward-firing driver 104. The controller 148 includes a wide bandpass filter 170 that allows frequencies between ($f_{L1}$-$f_{H1}$). In one or more embodiments, the wide bandpass filter 170 allows frequencies between 200 Hz to 2 kHz. The controller 148 also includes a delay circuit 172 with a delay ($d_1$) to time align the first forward-firing driver 104 with the upward-firing driver 102 by compensating for a spatial distance between the corresponding sound beams relative to the listening area. The controller 148 includes a gain circuit 174 with a gain ($G_1$) to amplify sound components to compensate for a difference in efficiency between drivers. The controller 148 also includes an equalization circuit 176 with a PEQ filter to adjust the frequency response.

The first and second intermediate drivers 150, 152 are mounted below the first forward-firing driver 104 within the cabinet 106 and arranged to project forward sound beams (not shown) about forward axes that are parallel with the forward axis 110 and out of the front face 168 of the cabinet 106 toward the target listening area, according to one or more embodiments. In one or more embodiments, the pair of intermediate drivers are mid-range drivers. The controller 148 includes circuitry for conditioning the front-right (FR) channel signal that is provided to the first and second intermediate drivers 150, 152.

The controller 148 includes a bandpass filter 180 that allows frequencies between ($f_{L2}$-$f_{H2}$). In one or more embodiments, the bandpass filter 180 allows frequencies between 400 Hz to 1.5 kHz. The controller 148 also includes a delay circuit 182 with a delay ($d_2$) to time align the first intermediate driver 150 with the upward-firing driver 102 by compensating for a spatial distance between the corresponding sound beams relative to the listening area. The controller 148 includes a gain circuit 184 with a gain ($G_2$) to amplify sound components to compensate for a difference in efficiency between drivers. The controller 148 also includes an equalization circuit 186 with a PEQ filter to adjust the frequency response.

The controller 148 includes a bandpass filter 190 that allows frequencies between ($f_{L3}$-$f_{HD}$). In one or more embodiments, the bandpass filter 190 allows frequencies between 400 Hz to 1.5 kHz. The controller 148 also includes a delay circuit 192 with a delay ($d_3$) to time align the second intermediate driver 152 with the upward-firing driver 102 by compensating for a spatial distance between the corresponding sound beams relative to the listening area. The controller 148 includes a gain circuit 194 with a gain ($G_3$) to amplify sound components to compensate for a difference in efficiency between drivers. The controller 148 also includes an equalization circuit 196 with a PEQ filter to adjust the frequency response.

The lower driver 154 is mounted below the intermediate drivers 150, 152 within the cabinet 106 and arranged to project a forward sound beam (not shown) about a forward axis that is parallel with the forward axis 110 and out of the front face 168 of the cabinet 106 toward the target listening area, according to one or more embodiments. It should be noted that the combination of four drivers is projecting sound upwards—although in one or more embodiments, three of the four drivers face forward, the overall acoustic profile is configured to project sound upwards to the ceiling. The forward-facing component is primarily coming from 104 as shown in FIG. 1. In one or more embodiments, the lower driver 154 includes an array of drivers, such as the Radiance™ or Citation™ Towers by Harman. The controller 148 includes circuitry for conditioning the front-right (FR) channel signal that is provided to the lower driver 154. The controller 148 includes a low pass filter 200 with a cutoff frequency ($f_{L4}$) to remove the high frequency portion of the FR channel signal. In one or more embodiments the cutoff frequency ($f_{L4}$) is 500 Hz. The controller 148 also includes a delay circuit 202 with a delay ($d_4$) to time align the lower driver 154 with the upward-firing driver 102 by compensating for a spatial distance between the corresponding sound beams relative to the listening area. The controller 148 includes a gain circuit 204 with a gain ($G_4$) to amplify sound components to compensate for a difference in efficiency between drivers. The controller 148 also includes an equalization circuit 206 with a (PEQ) filter to adjust the frequency response.

The circuit elements of the controller 148 illustrated in FIG. 3 may be implemented as an analog circuit using known analog components (e.g., capacitors, inductors, resistors, etc.) and known circuit designs. Alternatively, it may be implemented as a digital circuit using digital signal processor (DSP) components, logic gates, programmable arrays, or other digital circuits.

Figure 4:
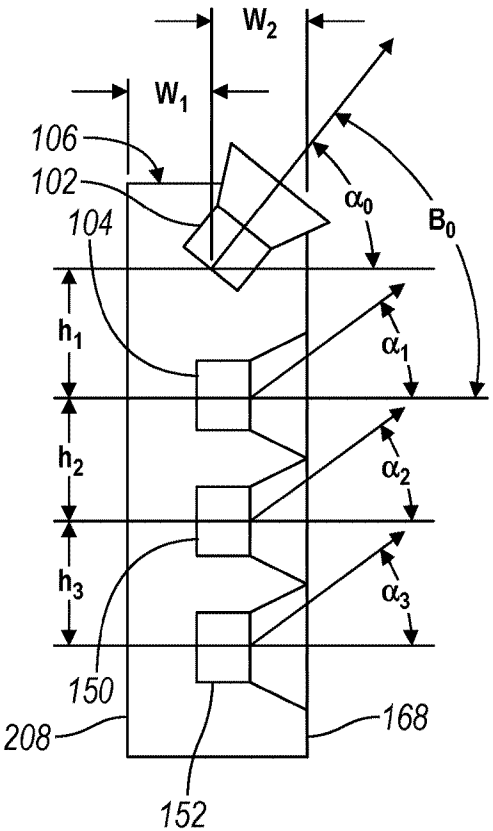
FIG. 4 is an enlarged view of a portion of the speaker system of FIG. 2.

Referring to FIG. 4, the directivity of the speaker system 100 may also be improved by varying mechanical parameters of the speakers, such as the angle of inclination ($\alpha$) or splay angle ($\beta$) of the drivers, the vertical spacing or height (h) between the drivers, the lateral width position (W) of the driver relative to the outer surfaces of the cabinet 106, and the frequency of the drivers.

The angle of inclination ($\alpha$) of each driver refers to the angular offset between a firing axis of a driver and an imaginary axis extending through the center of the driver and perpendicularly from a front face of the cabinet 106. A splay angle ($\beta$) refers to the angular offset between the firing axes of two vertically adjacent drivers. In one or more embodiments, the forward—firing drivers 104, 150, 152 each have an angle of inclination ($\alpha$) of zero degrees, and a splay angle ($\beta$) with respect to a lower driver, of zero degrees. The upward-firing driver 102 has an acute angle of inclination ($\alpha_0$) that is equal to its splay angle ($\beta_0$), and between 60 and 80 degrees. In one or more embodiments, $\alpha_0$ and $\beta_0$ are both equal to 70 degrees.

The vertical spacing or height (h) between the drivers is based on the dimensions of the drivers, and directivity increases as number of drivers in a line array increases. In one or more embodiments the drivers are equally spaced apart, e.g., at 40 mm spacing.

The lateral width position (W) of the upward firing driver relative to the outer surfaces of the cabinet 106 is also based on the dimensions of the driver. In one or more embodiments the upward driver is centrally located between the front face 168 and a rear surface 208 of the cabinet 106, e.g., such that W1 and W2 are equal to 40 mm.

Figure 5:
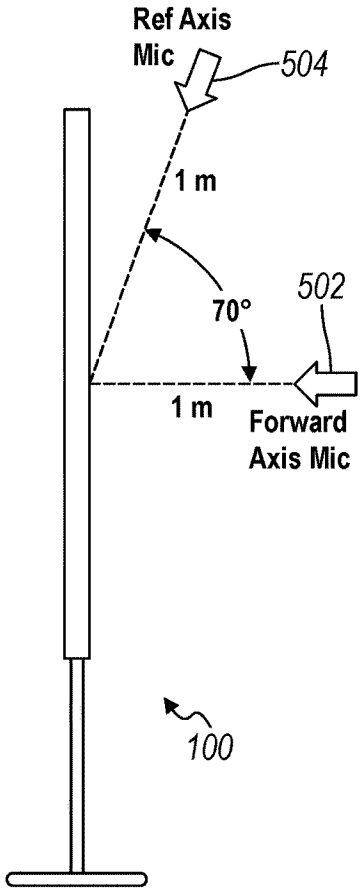
FIG. 5 is a diagram illustrating a test setup for measuring the directivity of the speaker system of FIG. 2, including the locations of measurement microphones relative to the speaker system.

FIG. 5 illustrates a test setup for measuring the directivity of a speaker system, such as speaker system 100, in multiple directions. The test setup includes a first microphone 502 for measuring forward directivity and a second microphone 504 for measuring rearward directivity.

Figure 6:
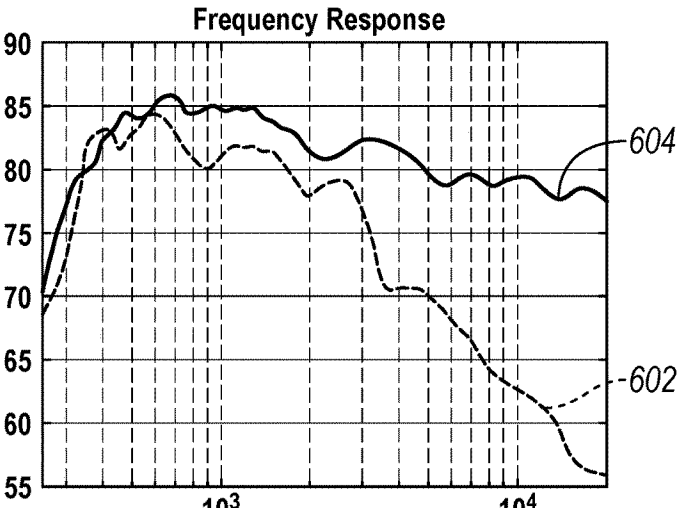
FIG. 6 is a graph illustrating a frequency response curve from each microphone of FIG. 5.
Figure 7:
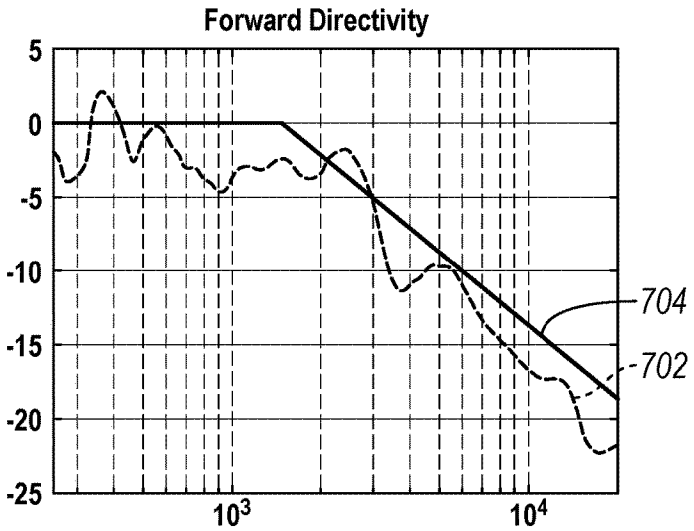
FIG. 7 is a graph illustrating a forward directivity curve along with a target directivity curve.

FIG. 6 is a graph illustrating a first frequency response curve 602 measured by the first microphone 502 and a second frequency response curve 604 measured by the second microphone 504. FIG. 7 is a graph illustrating a forward directivity curve 702 along with a target directivity curve 704.

Figure 8:
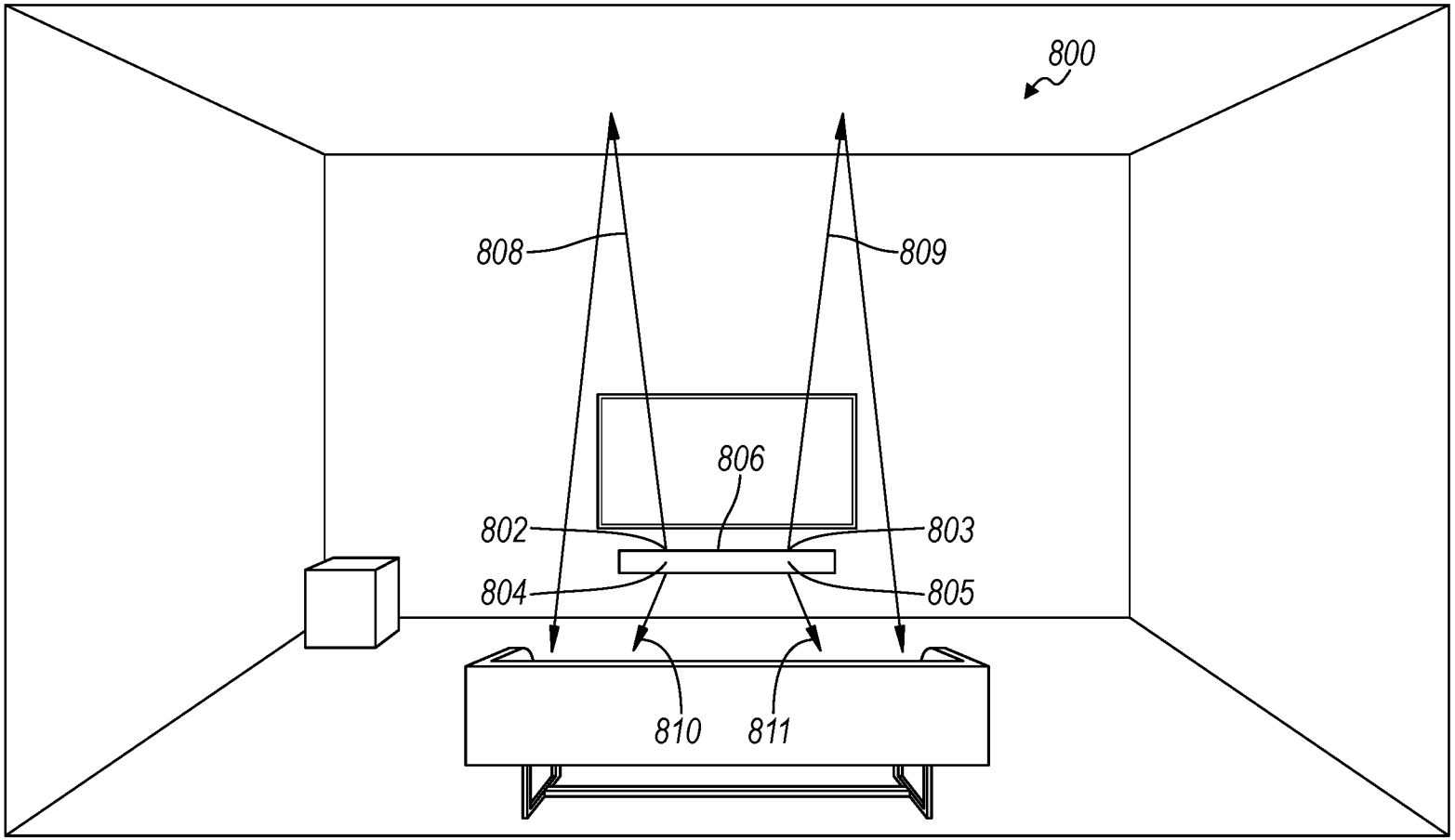
FIG. 8 is a front perspective view of an audio system including another speaker system with overhead sound projection within the listening environment.
Figure 9:
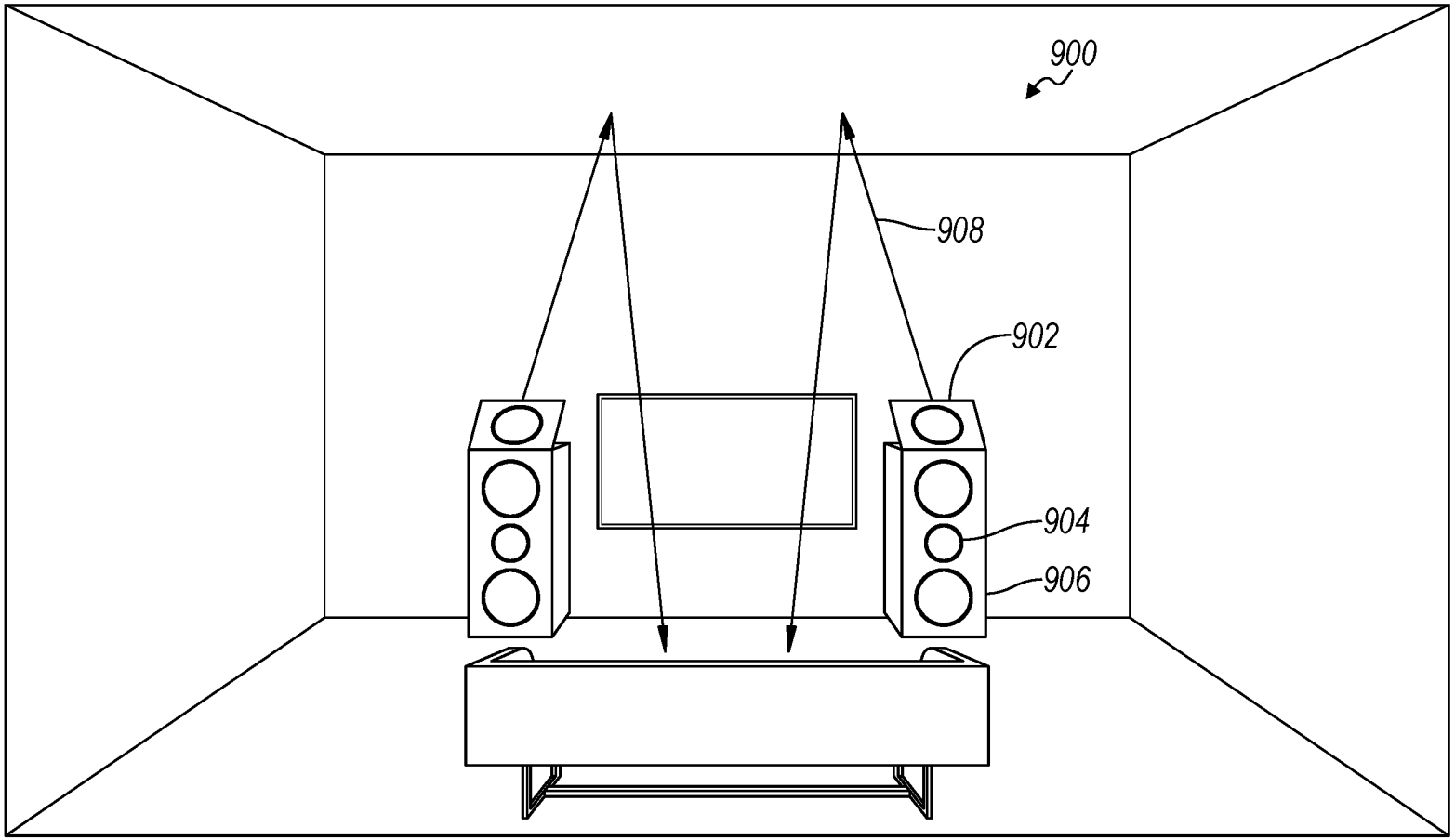
FIG. 9 is a front perspective view of an audio system including other speaker systems with overhead sound projection within the listening environment.

FIGS. 8 and 9 illustrate additional embodiments, in which the speaker system with overhead sound projection is implemented in different types of speaker assemblies. With reference to FIG. 8, a sound bar speaker system with overhead sound projection is illustrated in accordance with one or more embodiments and represented by numeral 800. The speaker system 800 includes a pair of upward firing drivers 802, 803 and a pair of forward firing drivers 804, 805 that are all supported by a cabinet 806. The upward firing drivers 802 are mounted to an upper portion of the cabinet 806 and arranged to project a top-firing sound beam about upward axes 808, 809 toward an upper surface, e.g., a ceiling, which reflects toward a target listening area. This reflected top-firing sound beam simulates sound generated by a speaker mounted to the ceiling (not shown). The forward firing drivers 804 are mounted below the upward firing drivers 802 within the cabinet and arranged to project forward sound beams about forward axes 810, 811 and out of a front face of the cabinet 806 toward the target listening area. The speaker system 800 is implemented in a sound bar, according to one or more embodiments.

With reference to FIG. 9, a pair of sound box speaker systems with overhead sound projection is illustrated in accordance with one or more embodiments and represented by numeral 900. Each speaker system 900 includes an upward firing driver 902 and at least one forward firing driver 904 that is supported by a cabinet 906. Each upward firing driver 902 is mounted to an upper portion of the cabinet 906 and arranged to project a top-firing sound beam about an upward axis 908 toward an upper surface, e.g., a ceiling, which reflects toward a target listening area. This reflected top-firing sound beam simulates sound generated by a speaker mounted to the ceiling (not shown). Each forward firing driver 904 is mounted below the corresponding upward firing driver 902 within the cabinet and arranged to project forward sound beams about a forward axis (not shown) and out of a front face of the cabinet 906 toward the target listening area. The speaker system 900 is implemented in a sound box, according to one or more embodiments.

While exemplary embodiments are described above, it is not intended that these embodiments describe all possible forms. Rather, the words used in the specification are words of description rather than limitation, and it is understood that various changes may be made without departing from the spirit and scope of the disclosure. Additionally, the features of various implementing embodiments may be combined to form further embodiments.

What is claimed is:

1. A speaker system comprising:

a cabinet with a front face;

at least one forward-firing driver supported by the cabinet to project sound along a first axis that is generally perpendicular to the front face of the cabinet;

at least one upward-firing driver supported by the cabinet and arranged above the at least one forward-firing driver to project high frequency sound along a second axis that is angularly offset from the first axis at an acute splay angle; and a controller programmed to:

apply a gain to a mid-range frequency component of a front audio channel based on a difference in efficiency between the at least one forward-firing driver and the at least one upward-firing driver, provide the mid-range frequency component of the front audio channel to the at least one forward-firing driver, and provide a high frequency component of a top audio channel to the upward-firing driver.

2. The speaker system of claim 1, wherein the controller is further programmed to:

filter the top audio channel to remove a low frequency component below a cut-off frequency of approximately 1 kHz; and filter the front audio channel to remove frequency components outside a frequency band of approximately 200 Hz-2 kHz.

3. The speaker system of claim 1, wherein the controller is further programmed to filter the mid-range frequency component of the front audio channel to include a time delay corresponding to a spatial distance difference between the cabinet and a listening area along the first axis and the second axis reflected off of an upper surface.

4. The speaker system of claim 1, wherein the controller is further programmed to equalize the high frequency component of the top audio channel based on a room height proximate the cabinet.

5. The speaker system of claim 1 further comprising:

a low frequency driver supported by the cabinet to project sound along a third axis that is generally parallel to the first axis; and wherein the controller is further programmed to provide a low frequency component of the front audio channel to the low frequency driver.

6. The speaker system of claim 1, wherein the cabinet is formed in one of a column, a sound bar, and a sound box configuration.

7. The speaker system of claim 1, wherein the cabinet is formed in a column configuration and the acute splay angle is between 60-80 degrees.

8. The speaker system of claim 7, wherein each of the at least one forward-firing driver and the at least one upward-firing driver is formed with a diameter of approximately 20-40 mm.

9. The speaker system of claim 8, wherein a vertical spacing between the at least one forward-firing driver and the at least one upward-firing driver is approximately 40 mm.

10. The speaker system of claim 9, wherein the upward-firing driver is centrally located between the front face and a rear surface of the cabinet.

11. A home entertainment system comprising:

first and second speaker systems, each according to claim 1, to mount to a front right portion of a room and to a front left portion of the room.

12. A speaker system comprising:

a cabinet with a front face;

a first driver supported by the cabinet to project sound along a first axis that is generally perpendicular to the front face of the cabinet;

a second driver supported by the cabinet and arranged above the first driver to project high frequency sound along a second axis that is angularly offset from the first axis at an acute splay angle; and a third driver supported by the cabinet and arranged below the first driver to project low frequency sound along a third axis that is generally parallel to the first axis;

a controller programmed to:

filter a front audio channel to remove frequency components outside a frequency band of approximately 200 Hz-2 kHz, provide a mid-range frequency component of the front audio channel to the first driver, filter a top audio channel to remove a frequency component below a cut-off frequency of approximately 1 kHz, provide a high frequency component of the top audio channel to the second driver to project as mid-range frequency sound along the second axis, and provide a low frequency component of the front audio channel to the third driver.

13. The speaker system of claim 12, wherein the controller is further programmed to filter the mid-range frequency component of the front audio channel to include a time delay corresponding to a spatial distance difference between the cabinet and a listening area along the first axis and the second axis reflected off of an upper surface.

14. The speaker system of claim 12, wherein the controller is further programmed to equalize the high frequency component based on a room height proximate the cabinet.

15. The speaker system of claim 12, wherein the controller is further programmed to apply a gain to the mid-range frequency component based on a difference in efficiency between the first driver and the second driver.

16. A home entertainment system comprising:

first and second speaker systems, each according to claim 12, to mount to a front right portion of a room and to a front left portion of the room.

17. A method for projecting overhead sound from a speaker system comprising:

providing a mid-range frequency component of a front audio channel to a first driver to project sound along a first axis that is generally perpendicular to a front face of a cabinet;

equalizing a high frequency component of a top audio channel based on a room height proximate the cabinet;

providing the high frequency component of the top audio channel to a second driver to project as high frequency sound along a second axis that is angularly offset from the first axis at an acute splay angle; and providing a low frequency component of the front audio channel to a third driver to project low frequency sound along a third axis that is generally parallel to the first axis.

18. The method of claim 17, further comprising:

applying a gain to the mid-range frequency component based on a difference in efficiency between the first driver and the second driver.

19. The method of claim 17, further comprising:

filtering the top audio channel to remove a frequency component below a cut-off frequency of approximately 1 kHz; and filtering the front audio channel to remove frequency components outside a frequency band of approximately 200 Hz-2 kHz.

20. The method of claim 17 further comprising:

filtering the mid-range frequency component of the front audio channel to include a time delay corresponding to a spatial distance difference between the cabinet and a listening area along the first axis and the second axis.

* * * * *